US006480821B2

(12) United States Patent
Macho et al.

(10) Patent No.: US 6,480,821 B2
(45) Date of Patent: Nov. 12, 2002

(54) METHODS AND APPARATUS FOR REDUCING NOISE ASSOCIATED WITH AN ELECTRICAL SPEECH SIGNAL

(75) Inventors: Dusan Macho, Schaumburg, IL (US); Yan Ming Cheng, Schaumburg, IL (US)

(73) Assignee: Motorola, Inc., Schaumburg, IL (US)

( * ) Notice: Subject to any disclaimer, the term of this patent is extended or adjusted under 35 U.S.C. 154(b) by 162 days.

(21) Appl. No.: 09/774,840

(22) Filed: Jan. 31, 2001

(65) Prior Publication Data

US 2002/0103640 A1 Aug. 1, 2002

(51) Int. Cl.[7] ..... G10L 21/02
(52) U.S. Cl. ..... 704/207; 704/233
(58) Field of Search ..... 704/207, 205, 704/208, 213, 231, 220, 222, 214, 218, 230, 209, 262, 265, 268, 248, 233, 270.1

(56) References Cited

U.S. PATENT DOCUMENTS 4,630,304 A * 12/1986 Borth et al. ..... 381/317
5,706,395 A * 1/1998 Arslan et al. ..... 704/226
5,999,897 A * 12/1999 Yeldener ..... 704/207
6,263,307 B1 * 7/2001 Arslan et al. ..... 704/205

* cited by examiner

*Primary Examiner*—Richemond Dorvil
(74) *Attorney, Agent, or Firm*—Daniel K. Nichols

(57) ABSTRACT

A system for enhancing the signal-to-noise ratio of a speech signal is avoided. A plurality of local energy maximums associated with a speech signal are determined. Presumably, each of these local energy maximums defines a speech pitch period. Typically, human pitch periods are approximately 100–400 Hz depending on the sex and age of the speaker. Because human speech typically includes more energy near the beginning of a pitch period than at the end of the pitch period, and background noise tends to remain relatively constant throughout the pitch period, the speech signal may be enhanced by increasing the energy associated with the beginning of the pitch period and/or by decreasing the energy associated with the end of the pitch period. Preferably, the amount of energy increase in the earlier portion of the pitch period is approximately equal to the amount of energy reduction in the later portion of the pitch period. In this manner, the total energy remains the constant.

27 Claims, 4 Drawing Sheets

METHODS AND APPARATUS FOR REDUCING NOISE ASSOCIATED WITH AN ELECTRICAL SPEECH SIGNAL

TECHNICAL FIELD

The present invention relates in general to processing speech signals and, in particular, to methods and apparatus for reducing noise associated with an electrical speech signal.

BACKGROUND

Speech signals are often degraded by the presence of noise. For example, the difficulty a speech recognition system has in recognizing words in a speech signal is increased by the presence of background noise. Further to this example, an automatic speech recognition system in a cellular telephone must overcome the presence of road noise, factory noise, etc. Currently, many attempts to improve the robustness of the front-end portion of automatic speech recognition systems against additive noise distortion are being made. In general, all of these attempts are based on the ides of estimating and reducing the noise in the frequency domain. For example, spectral subtraction or Wiener filtering made be used to reduce noise in the frequency domain. However, these techniques have reached a performance plateau and additional processing techniques are required.

BRIEF DESCRIPTION OF THE DRAWINGS

Features and advantages of the disclosed system will be apparent to those of ordinary skill in the art in view of the detailed description of exemplary embodiments which is made with reference to the drawings, a brief description of which is provided below.

DETAILED DESCRIPTION OF EXEMPLARY EMBODIMENTS

In general, the system described herein enhances the signal-to-noise ration of a speech signal. A plurality of local energy maximums associated with a speech signal are determined. Presumably, each of these local energy maximums defines a speech pitch period. Typically, human pitch periods are approximately 100–400 Hz depending on the sex and age of the speaker. Because human speech typically includes more energy near the beginning of a pitch period than at the end of the pitch period, and background noise tends to remain relatively constant throughout the pitch period, the speech signal may be enhanced by increasing the energy associated with the beginning of the pitch period and/or by decreasing the energy associated with the end of the pitch period. Preferably, the amount of energy increase in the earlier portion of the pitch period is approximately equal to the amount of energy reduction in the later portion of the pitch period. In this manner, the total energy remains the constant.

Figure 1:
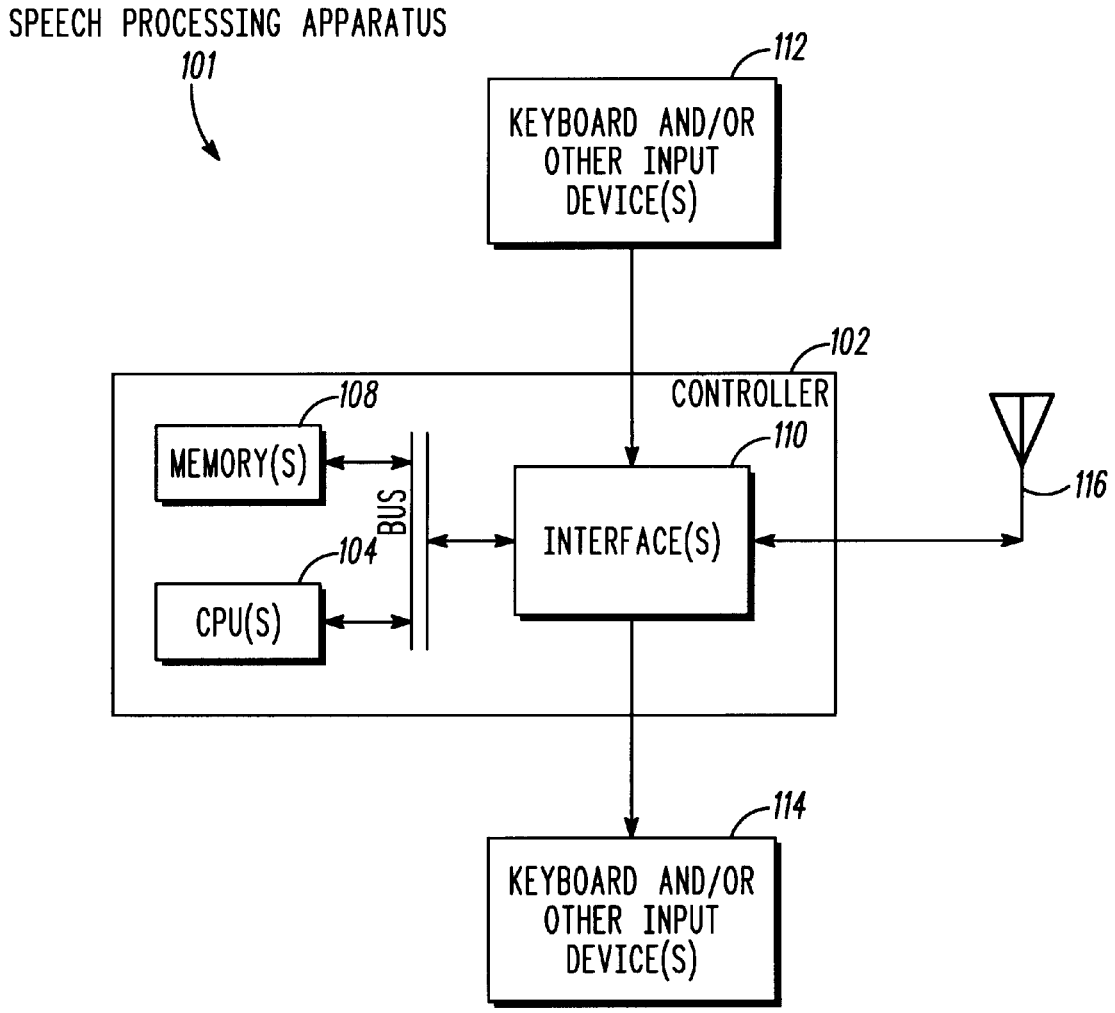
FIG. 1 is a block diagram illustrating one embodiment of a speech processing apparatus.

A block diagram of a speech processing apparatus 101 is illustrated in FIG. 1. The speech processing apparatus 101 is preferably embodied in radio device such as a cellular telephone or two-way radio. However, the speech processing apparatus 101 may be embodied in a personal computer (PC), a personal digital assistant (PDA), an Internet appliance, or any other communication device. The speech processing apparatus 101 preferably includes a controller 102 which preferably includes a central processing unit 104 electrically coupled by an address/data bus 106 to a memory device 108 and an interface circuit 110. The CPU 104 may be any type of well known CPU. The memory device 108 preferably includes volatile memory and non-volatile memory. Preferably, the memory device 108 stores a software program that performs some or all of the method described below. This program may be executed by the CPU 104 in a well known manner.

The interface circuit 210 may be implemented using any type of well known interface standard, such as a serial peripheral interface (SPI), a serial communications interface (SCI), interface-to-interface communications (I2C), or a parallel interface. One or more input devices 112 may be connected to the interface circuit 110 for entering data and commands into the controller 102. For example, the input device 112 may be a keyboard.

One or more displays, speakers, and/or other output devices 114 may also be connected to the controller 102 via the interface circuit 110. The display 114 may be a liquid crystal displays (LCDs), a light emitting diode display (LED), or any other type of display. The display 114 generates visual displays of data generated during operation of the controller 102. The display 114 is typically used to display names, phone numbers, setup options, menus, commands, etc. The visual displays may include prompts for human operator input, run time statistics, calculated values, detected data, etc.

In addition, the speech processing apparatus 101 may include a radio frequency (RF) antenna 116. In such an instance, the antenna 116 may be coupled to the speech processing apparatus 101 via the interface circuit 110 and/or other RF interface circuitry. Preferably, the antenna facilitates voice and data communications with other devices such as telephones, radios, and base stations.

Figure 2:
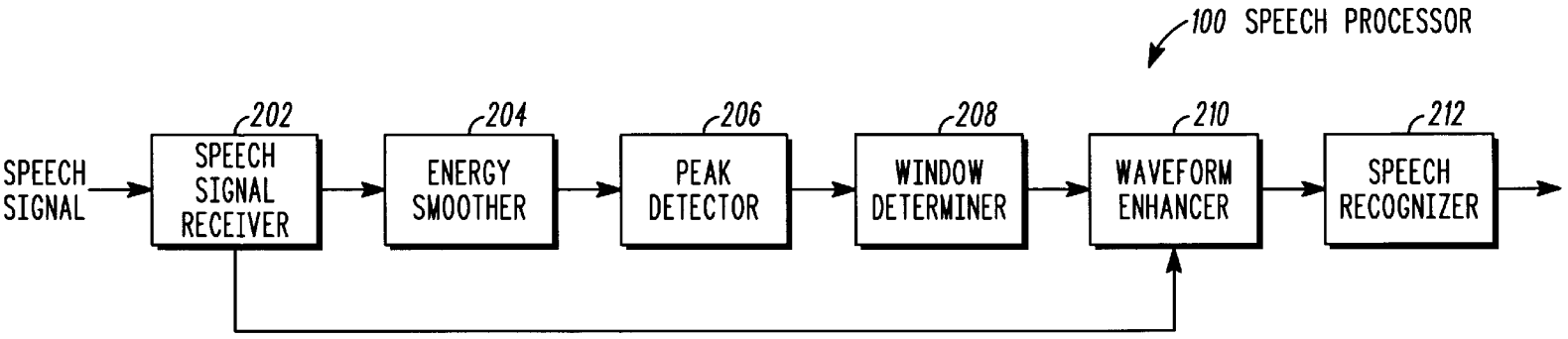
FIG. 2 is a block diagram showing another embodiment of a speech processing apparatus.

A block diagram of a speech processor 100 is illustrated in FIG. 2. In this embodiment, the speech processor 100 includes a plurality of interconnected modules 202–212. Each of the modules may be implemented by a microprocessor or a digital signal processor (DSP) executing software instructions and/or conventional electronic circuitry. In addition, a person of ordinary skill in the art will readily appreciate that certain modules may be combined or divided according to customary design constraints.

For the purpose of receiving speech signals, the speech processor 100 includes a speech signal receiver 202. The speech signal receiver 202 may receive speech signals from any source. For example, the speech signal receiver 202 may receive speech signals from a microphone (not shown) or the RF antenna 116. The speech signal receiver 202 may receive analog or digital speech signals. In one embodiment, the speech signal receiver 202 converts a received speech signal from analog to digital. In another embodiment, the speech signal receiver 202 converts the received speech signal from digital to analog. Of course, a person of ordinary skill in the art will readily appreciate that the speech signal receiver 202 may not perform any conversion on the received speech signal.

For the purpose of determining a smoothed energy signal based on a received speech signal, the speech processor 100 includes an energy smoother 204. The energy smoother 204 is operatively coupled to the speech signal receiver. The energy smoother 204 produces a representation of the amount of energy present in the received speech signal at multiple points in the time domain of the speech signal. Preferably, the energy smoother 204 comprises a Teager operator and/or a moving average calculation. Generally, the Teager operator consists of subtracting the product of a previous sample and a subsequent sample from the current sample squared (e.g., Teager(i)=S2(i)−(S(i−1)*S(i+1)). However, a person of ordinary skill in the art will readily appreciate that any structure which produces a representation of the amount of energy present in the received speech signal at multiple points in the time domain may be used in the scope and spirit of the present invention.

For the purpose of determining times associated with local energy maximums based on the smoothed energy signal, the speech processor 100 includes a peak detector 206. The peak detector 206 is operatively coupled to the energy smoother 204. The peak detector 206 locates one or more local energy maximums associated with the smoothed energy signal in the time domain. The peak detector 206 preferably operates on the smoothed energy output instead of the received speech signal to reduce false peaks from low energy spikes.

Presumably, each of these local energy maximums defines a speech pitch period. Typically, human pitch periods are approximately 100–400 Hz depending on the sex and age of the speaker. Because human speech typically includes more energy near the beginning of a pitch period than at the end of the pitch period, and background noise tends to remain relatively constant throughout the pitch period, the speech signal may be enhanced by increasing the energy associated with the beginning of the pitch period and/or by decreasing the energy associated with the end of the pitch period. Preferably, the amount of energy increase in the earlier portion of the pitch period is approximately equal to the amount of energy reduction in the later portion of the pitch period. In this manner, the total energy remains the same, and the speech does not become louder or softer.

For the purpose of determining one or more portions of the received speech signal to be enhanced based on the times associated with certain local energy maximums, the speech processor 100 includes a window determiner 208. The window determiner 208 is operatively coupled to the peak detector 206. Preferably, the window determiner 208 selects a first portion of the speech signal including and/or coming after a local energy peak. In addition, the window determiner 208 may select a second portion of the speech signal which comes before the next local energy peak.

For example, the window determiner 208 may define a first time window starting at a particular energy peak and extending 80% of the way to the next energy peak, thereby defining a second time window as the remaining 20% of the pitch period. Preferably, the speech signal energy is increased in the first time window and decreased in the second time window for each pitch period. Of course, a person of ordinary skill in the art will readily appreciate that any percentages may be used and the windows need not occupy 100% of the pitch period.

For the purpose of increasing and/or decreasing energy levels associated with certain portions of the received speech signal to create an enhanced speech signal, the speech processor 100 includes a waveform enhancer 210. The waveform enhancer 210 is operatively coupled to the speech signal receiver 202 and the window determiner 208. The waveform enhancer 210 increases speech signal energy in the first time window of each pitch period and/or decreases speech signal energy in the second time window of each pitch period. Preferably, the amount of energy increase in the first portion is approximately equal to the amount of energy decrease in the second portion, so the total energy remains relatively constant. Increasing and/or decreasing energy is performed in a well known manner. For example, the waveform within each frame may be modified by using the windowing function w(n) and a weighting parameter ϵ like:

$$SSNR(n)=f(\epsilon)\cdot SHighSNR(n)+\epsilon\cdot SLowSNR(n)=f(\epsilon)\cdot w(n)s(n)+\epsilon\cdot(1-w(n))s(n)$$

where $$f(e)=(\mathrm{sum}(abs(s(n))\hat{}2)-(\epsilon\hat{}2\cdot \mathrm{sum}\ (abs((1-w(n))s(n))\hat{}2)))/(\mathrm{sum}((abs(w(n)s(n))\hat{}2))\ \hat{}(½)$$

with $$0<\epsilon<=1 \text{ and } f(\epsilon)>=1.$$

The parameter ϵ determines the degree of attenuation of low signal-to-noise ratio portions with respect to high signal-to-noise ratio portions and f(ϵ) is a function of ϵ that ensures the total frame energy after processing is the same as that before processing. Preferably, the parameters are experimentally set to optimize different speech and noise conditions.

For the purpose of determining a human word based on the enhanced speech signal, the speech processor 100 optionally includes a speech recognizer 212. The speech recognizer 212 is operatively coupled to the waveform enhancer 210. The speech recognizer 212 receives the enhanced speech signal from the waveform enhancer 210 and perform speech recognition process on the enhanced speech signal in a well known manner. Typically, the speech recognizer 212 includes a standard front end processor and a standard back end automatic speech recognition block.

Figure 3:
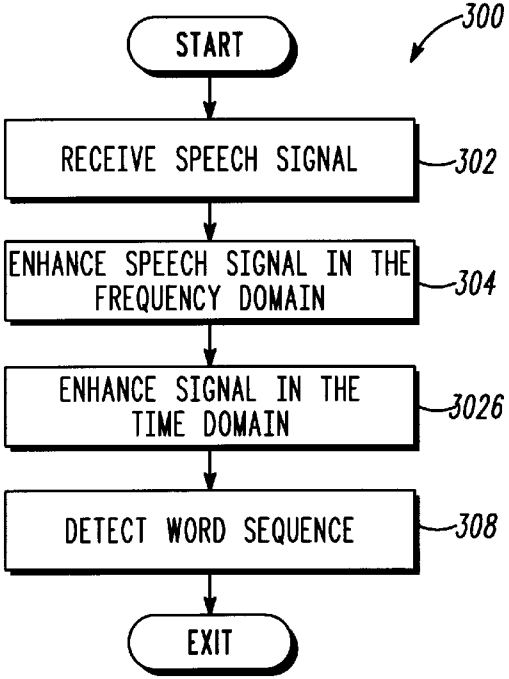
FIG. 3 is a flowchart of a process for performing speech recognition including a time-domain signal enhancement step.

A flowchart of a process 300 for performing speech recognition including a time-domain signal enhancement step is illustrated in FIG. 3. Preferably, the process 300 is embodied in a software program which is stored in the memory 108 and executed by the CPU 104 in a well known manner. However, some or all of the steps of the process 300 may be performed manually and/or by another device. Although the process 300 is described with reference to the flowchart illustrated in FIG. 3, a person of ordinary skill in the art will readily appreciate that many other methods of performing the acts associated with process 300 may be used. For example, the order of many of the steps may be changed without departing from the scope or spirit of the present invention. In addition, many of the steps described are optional.

Generally, the process 300 receives a speech signal, enhances the speech signal, and recognizes one or more words in the speech signal. The process 300 begins when the speech signal receiver 202 receives the speech signal in a well known manner (step 302). The speech signal may then be enhanced in the frequency domain in a well known manner (step 304). For example, one or more predetermined frequency ranges may be amplified and/or one or more predetermined frequency ranges may be attenuated. Similarly, the speech signal may be enhanced in the frequency domain using a spectral subtraction process and/or a Wiener filtering process. Subsequently, the speech signal is preferably enhanced in the time domain as described in detail with reference to FIG. 4 below. (step 306). Finally, the enhanced speech signal may be output to a speaker 114 and/or fed into a speech recognizer 212 to recognize a word sequence (step 308).

Figure 4:
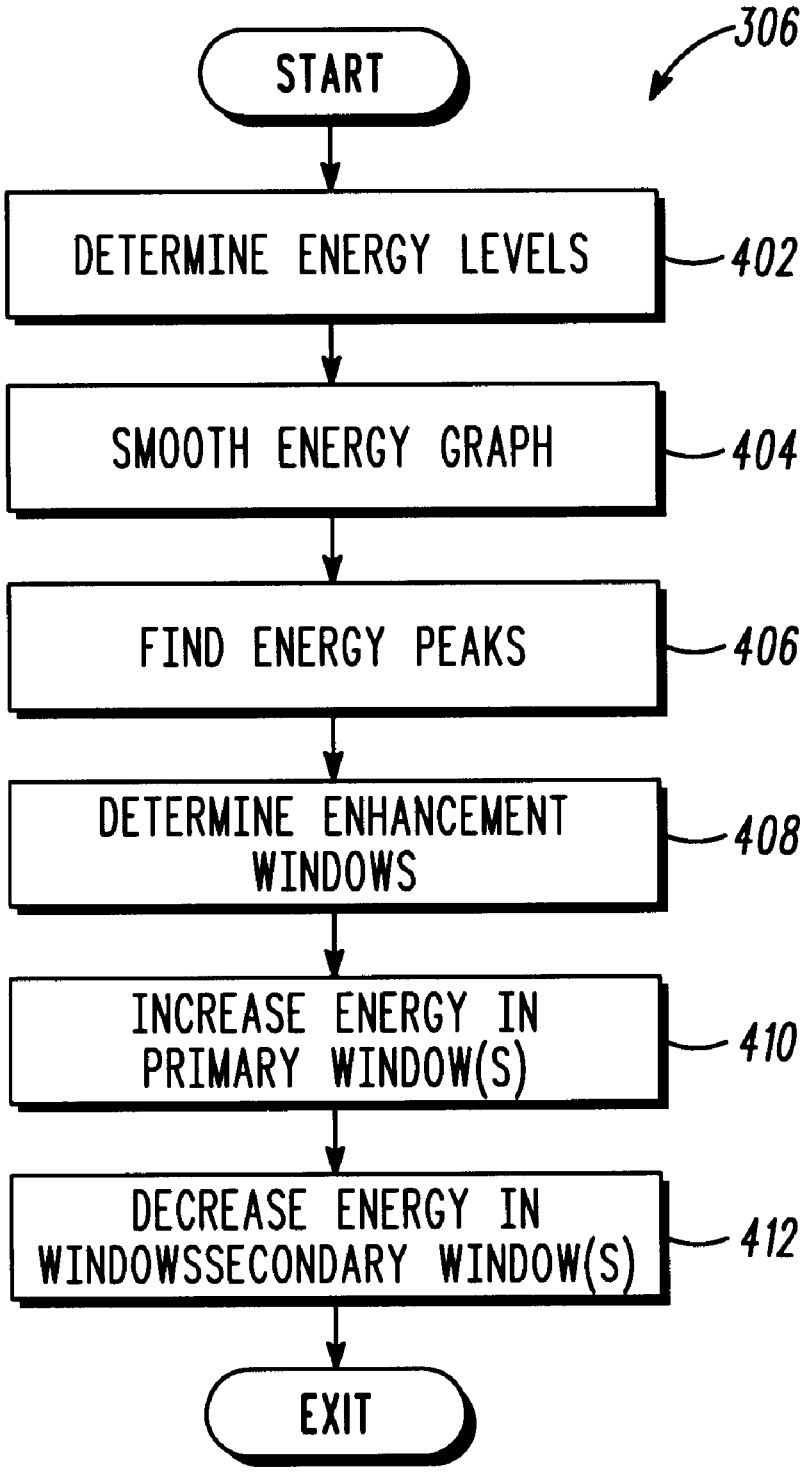
FIG. 4 is a more detailed flowchart of the time-domain signal enhancement step illustrated in FIG. 3.

A more detailed flowchart of the time-domain signal enhancement step 306 is illustrated in FIG. 4. Preferably, the process 306 is embodied in a software program which is stored in the memory 108 and executed by the CPU 104 in a well known manner. However, some or all of the steps of the process 306 may be performed manually and/or by another device. Although the process 306 is described with reference to the flowchart illustrated in FIG. 4, a person of ordinary skill in the art will readily appreciate that many other methods of performing the acts associated with process 306 may be used. For example, the order of many of the steps may be changed without departing from the scope or spirit of the present invention. In addition, many of the steps described are optional.

Generally, the process 306 locates local energy peaks in a smoothed energy "graph" and uses the located peaks to increase energy levels in one time window(s) and/or decrease energy levels in other time window(s). The process 306 begins by determining a plurality of energy levels (step 402). Preferably a Teager operator is used, but a person of ordinary skill in the art will readily appreciate that any method of determining energy levels of a speech signal may be used. In addition, the energy levels may be smoothed using a moving average type operator. Local maximums or peaks are then located in the smooth energy signal in a well known manner (step 406). Presumably, each of these local energy maximums defines a human speech pitch period.

Subsequently, one or more enhancement timing windows are determined (step 408). Preferably, the process 306 selects a primary portion of the speech signal including and/or coming after one local energy peak and a secondary portion of the speech signal which comes before the next local energy peak. For example, the process 306 may define a first time window starting at a particular energy peak and extending 80% of the way to the next energy peak, thereby defining a second time window as the remaining 20% of the pitch period.

Once the window(s) are determined, the process 306 increases the energy level in the primary window(s) (step 410) and decreases the energy level in the secondary window(s) (step 412) in a well known manner. Because human speech typically includes more energy near the beginning of a pitch period than at the end of the pitch period, and background noise tends to remain relatively constant throughout the pitch period, the speech signal may be enhanced by increasing the energy associated with the beginning of the pitch period and/or by decreasing the energy associated with the end of the pitch period. Preferably, the amount of energy increase in the primary portion of the pitch period is approximately equal to the amount of energy reduction in the secondary portion of the pitch period. In this manner, the total energy remains the same, and the speech does not become louder or softer.

Figure 5:
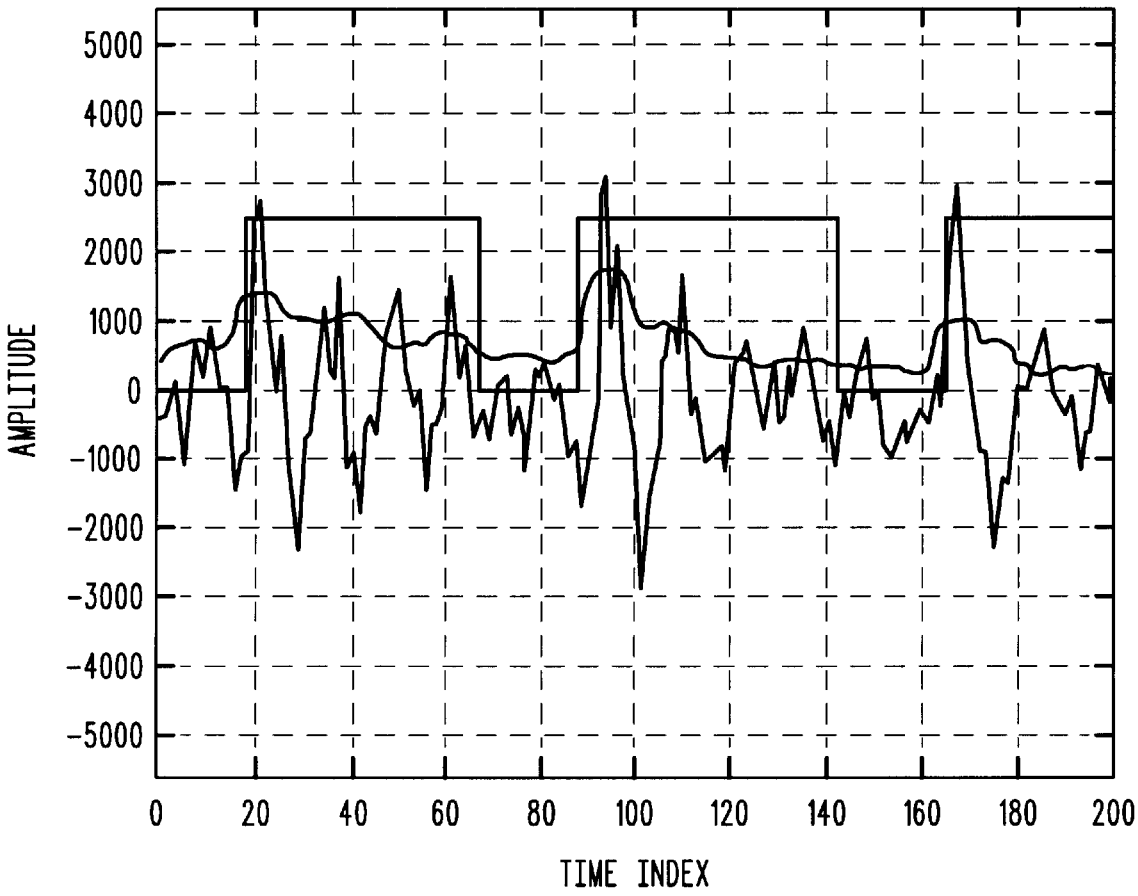
FIG. 5 is a graph of an exemplary speech signal before processing by the signal enhancement step of FIG. 4.

A graph of an exemplary speech signal before enhancement by the system described above is illustrated in FIG. 5. As described above, the energy associated with the speech signal in the primary window is increased after signal enhancement, and the energy associated with the speech signal in the secondary window is decreased after signal enhancement.

In summary, persons of ordinary skill in the art will readily appreciate that a method and apparatus for reducing noise associated with an electrical speech signal has been provided. Systems implementing the teachings described herein can enjoy cleaner speech signals fro speech recognition and other purposes.

The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description, but rather by the claims appended hereto.

What is claimed is:

1. A method of processing an electrical speech signal to reduce a noise portion of the electrical speech signal, the method comprising the steps of:

determining a plurality of energy levels associated with the electrical speech signal;

selecting a first local maximum energy level and a second local maximum energy level from the plurality of energy levels, the first local maximum energy level and the second local maximum energy level being separated by a time period;

determining a primary time window based on the first local maximum energy level, the primary time window excluding the second local maximum energy level, the primary time window being smaller than the time period;

determining a primary energy level associated with the electrical speech signal by summing a first subset of the plurality of energy levels, the first subset being defined by the primary time window;

determining a secondary time window based on the second local maximum energy level, the secondary time window excluding the first local maximum energy level, the secondary time window being smaller than the time period;

determining a secondary energy level associated with the electrical speech signal by summing a second subset of the plurality of energy levels, the second subset being defined by the secondary time window;

modifying the electrical speech signal such that the primary energy level is increased by a predefined amount; and modifying the electrical speech signal such that the secondary energy level is decreased by the predefined amount.

2. A method as defined in claim 1, further comprising the step of processing the electrical speech signal using a speech recognition process, the step of processing the electrical speech signal using the speech recognition process being performed after the step of modifying the electrical speech signal such that the primary energy level is increased by a predefined amount.

3. A method as defined in claim 2, wherein the step of processing the electrical speech signal using the speech recognition process is performed after the step of modifying the electrical speech signal such that the secondary energy level is decreased by the predefined amount.

4. A method as defined in claim 1, further comprising the steps of:

transforming the electrical speech signal from a time domain to a frequency domain;

modifying the electrical speech signal in the frequency domain to improve a signal-to-noise ratio associated with the electrical speech signal;

and transforming the electrical speech signal from the frequency domain to the time domain.

5. A method as defined in claim 4, wherein the step of modifying the electrical speech signal in the frequency domain to improve a signal-to-noise ratio associated with the electrical speech signal comprises the step of modifying the electrical speech signal using a spectral subtraction process.

6. A method as defined in claim 4, wherein the step of modifying the electrical speech signal in the frequency domain to improve a signal-to-noise ratio associated with the electrical speech signal comprises the step of modifying the electrical speech signal using a Wiener filtering process.

7. A method as defined in claim 1, wherein the step of determining a plurality of energy values associated with the electrical speech signal comprises the step of determining a plurality of smoothed energy values associated with the electrical speech signal.

8. A method as defined in claim 7, wherein the step of determining a plurality of smoothed energy values associated with the electrical speech signal comprises the step of calculating a Teager operator.

9. A method as defined in claim 1, wherein the step of selecting a first local maximum energy level and a second local maximum energy level from the plurality of energy levels comprises the steps of selecting the first local maximum energy level from a first pitch period and selecting the second local maximum energy level from a second different pitch period.

10. A method as defined in claim 1, wherein the step of determining a primary time window based on the first local maximum energy level comprises the step of identifying a contiguous time region extending from the first local maximum energy level toward the second local maximum energy level.

11. A method as defined in claim 10, wherein the step of identifying a contiguous time region extending from the first local maximum energy level toward the second local maximum energy level comprises the step of calculating a predetermined percentage of the time period.

12. A method of processing an electrical speech signal, the method comprising the steps of:

determining a plurality of energy levels associated with the electrical speech signal;

selecting a first local maximum energy level and a second local maximum energy level from the plurality of energy levels, the first local maximum energy level and the second local maximum energy level being separated by a time period;

determining a primary time window, the primary time window representing a contiguous time region including times after the first local maximum energy level and times before the second local maximum energy level, the primary time window encompassing a predetermined percentage of the time period, the predetermined percentage being less than one hundred percent; and increasing an energy level of the electrical speech signal in the primary time window.

13. A method as defined in claim 12, further comprising the step of decreasing an energy level of the electrical speech signal outside the primary time window.

14. A method as defined in claim 13, wherein the step of increasing an energy level of the electrical speech signal in the primary time window comprises the step of increasing the energy level of the electrical speech signal in the primary time window by a predetermined amount and the step of decreasing an energy level of the electrical speech signal outside the primary time window comprises the step of decreasing the energy level of the electrical speech signal outside the primary time window by a proportional amount, the proportional amount being within ten percent of the predetermined amount.

15. A method as defined in claim 12, wherein the predetermined percentage is less than eighty percent.

16. A method as defined in claim 12, further comprising the step of processing the electrical speech signal using a speech recognition process after the step of increasing an energy level of the electrical speech signal in the primary time window.

17. A method as defined in claim 12, further comprising the step of calculating a Teager operator associated with the electrical speech signal.

18. A method of processing an electrical speech signal, the method comprising the steps of:

determining a plurality of energy levels associated with the electrical speech signal;

selecting a first local maximum energy level and a second local maximum energy level from the plurality of energy levels, the first local maximum energy level and the second local maximum energy level being separated by a time period;

determining a primary time window, the primary time window representing a contiguous time region including times after the first local maximum energy level and times before the second local maximum energy level, the primary time window encompassing a predetermined percentage of the time period, the predetermined percentage being less than one hundred percent; and decreasing an energy level of the electrical speech signal outside the primary time window.

19. A method as defined in claim 18, further comprising the step of processing the electrical speech signal using a speech recognition process after the step of decreasing an energy level of the electrical speech signal outside the primary time window.

20. A method as defined in claim 18, further comprising the step of calculating a Teager operator associated with the electrical speech signal.

21. An apparatus for processing an electrical speech signal, the apparatus comprising:

a speech signal receiver structured to receive a speech signal;

an energy smoother operatively coupled to the speech signal receiver, the energy smoother structured to determine a smoothed energy signal based on the received speech signal;

a peak detector operatively coupled to the energy smoother, the peak detector being structured to determine a first time associated with a first local energy maximum based on the smoothed energy signal, the peak detector being structured to determine a second time associated with a second local energy maximum based on the smoothed energy signal;

a waveform enhancer operatively coupled to the speech signal receiver and the peak detector, the waveform enhancer being structured to increase a first energy level associated with a first portion of the received speech signal to create an enhanced speech signal, the first portion of the received speech signal having a first midpoint in time, the first midpoint of the received speech signal being located in time closer to the first time than the second time.

22. An apparatus as defined in claim 21, further comprising a speech recognition module operatively coupled to the waveform enhancer, the speech recognition module being structured to determine a human word based on the enhanced speech signal.

23. An apparatus as defined in claim 21, wherein the waveform enhancer is further structured to decrease a second energy level associated with a second portion of the received speech signal, the second portion of the received speech signal having a second midpoint in time, the second midpoint of the received speech signal being located in time closer to the second time than the first time.

24. An apparatus as defined in claim 23, wherein the waveform enhancer is structured to increase the first energy level and decrease the second energy by the same amount.

25. An apparatus as defined in claim 21, wherein the energy smoother comprises a Teager module.

26. An apparatus as defined in claim 21, wherein the energy smoother, the peak detector, and the waveform enhancer comprises software instructions structured for execution by a digital processor.

27. An apparatus for processing an electrical speech signal, the apparatus comprising:

a speech signal receiver structured to receive a speech signal;

an energy smoother operatively coupled to the speech signal receiver, the energy smoother structured to determine a smoothed energy signal based on the received speech signal;

a peak detector operatively coupled to the energy smoother, the peak detector being structured to determine a first time associated with a first local energy maximum based on the smoothed energy signal, the peak detector being structured to determine a second time associated with a second local energy maximum based on the smoothed energy signal;

a waveform enhancer operatively coupled to the speech signal receiver and the peak detector, the waveform enhancer being structured to decrease an energy level associated with a portion of the received speech signal to create an enhanced speech signal, the portion of the received speech signal having a midpoint in time, the midpoint of the received speech signal being located in time closer to the second time than the first time.

* * * * *